United States Patent [19]

Copham

[11] Patent Number: 5,020,434

[45] Date of Patent: Jun. 4, 1991

[54] BASE STOCK FOR SERIES CHECKS AND THE LIKE AND A METHOD OR PRINTING THE SAME

[75] Inventor: David L. Copham, Forest Lake, Minn.

[73] Assignee: Base Stock Press, Inc., Mounds View, Minn.

[21] Appl. No.: 567,146

[22] Filed: Aug. 14, 1990

[51] Int. Cl.[5] ..... B41F 1/34

[52] U.S. Cl. ..... 101/485; 283/58; 270/18; 270/52.5; 101/226; 101/240

[58] Field of Search ..... 101/485, 226, 232, 236–238, 101/240; 283/58; 270/1.1, 18, 52.5

[56] References Cited

U.S. PATENT DOCUMENTS

| | | | |
|---|---|---|---|
| 1,244,524 | 10/1917 | Marshall | 101/238 |
| 1,282,211 | 10/1918 | Fulk . | |
| 1,586,915 | 6/1926 | Pendergast . | |
| 1,925,586 | 9/1933 | Fulk . | |
| 1,939,196 | 12/1933 | Barber | 164/68 |
| 1,956,699 | 5/1934 | Russell | 101/232 |
| 1,977,566 | 10/1934 | Eckhard | 101/216 |
| 2,052,519 | 8/1936 | Smith | 164/60 |
| 2,213,569 | 9/1940 | Rohland | 101/181 |
| 2,226,888 | 12/1940 | Wyrick . | |
| 2,930,318 | 3/1960 | Stroud | 101/237 |
| 2,988,984 | 6/1961 | Eckert, Jr. et al. | 101/236 |
| 3,576,367 | 4/1971 | Sable | 101/226 |
| 3,899,946 | 8/1975 | Niepmann | 101/226 |
| 4,448,127 | 5/1984 | Frain | 270/1.1 |
| 4,463,677 | 8/1984 | Kuehfuss | 270/1.1 |
| 4,817,528 | 4/1989 | Baker | 101/485 |
| 4,903,600 | 2/1990 | Long | 270/1.1 |

FOREIGN PATENT DOCUMENTS

| | | | |
|---|---|---|---|
| 706655 | 5/1965 | Canada | 101/29 |

*Primary Examiner*—Eugene H. Eickholt
*Attorney, Agent, or Firm*—Kinney & Lange

[57] ABSTRACT

A method of forming stacks of printed material containing a set of printed patterns, each pattern in the set appearing at a selected printing area of each sheet in a selected sequence through the stacks, and the stack of material formed thereby. The method includes printing an arrangement of Y printed patterns along a length of a web in the selected sequence, severing the web in a direction transverse to the direction of travel or length of the web to form a plurality of printed sheets having Z printed patterns positioned along the length. The value of Z is selected to be greater than 1 and to equal a number other than a prime number or a multiple of a prime number of Y. By selection of a Z value as disclosed, the printed patterns in the set appear at a selected printing area in a predetermined sequence on consecutive pages in the stack.

21 Claims, 2 Drawing Sheets

BASE STOCK FOR SERIES CHECKS AND THE LIKE AND A METHOD OR PRINTING THE SAME

BACKGROUND OF THE INVENTION

The present invention relates generally to printing. In particular, it relates to the formation of stacks of printed material suitable for binding as checkbooks wherein images appear in a desired sequence through the steps of printing patterns onto a web, cutting the web to form a plurality of sheets, and stacking the sheets.

SUMMARY OF THE INVENTION

Checkbooks and share draft books having a variety of different printed background patterns, one on each page, are known. Several methods of forming checkbooks having a number of different background patterns are also known. One known method forms checkbooks having three images (A, B, and C), appearing in a selected repeating order (A, B, then C) on consecutive pages in the book. The method includes setting up a printing press to print a first arrangement of a plurality of A patterns onto the web. For example, three A patterns appear across the width of the web, and six A patterns appear along the length. The printed web is severed across the width of the web after each sixth image to form a plurality of sheets of paper. Each sheet contains a plurality of A patterns, eighteen in the example given.

The printing press is reset once for every different pattern appearing in the book. In the above example, the printing press is reset to print a plurality of B patterns, forming a second stack of sheets, and a plurality of C patterns, forming a third stack of sheets. The stacks are collated so that the patterns repeat (A, B, then C) with the collated stacks then being cut into smaller stacks of sheets, each sheet bearing a single pattern. Each smaller stack is bound along an edge to form a plurality of checkbooks, each having a plurality of alternating background patterns.

Another known method for forming checkbooks having a plurality of sequentially appearing background patterns also requires collation. This method includes setting up a printing press to print a first arrangement of background patterns onto a single sheet, the arrangement containing a number of different background patterns. For example, the first arrangement has a sequence of A, B, C, A, B, C background patterns printed along a length (column), and three patterns printed across the width (row) with each pattern in a row being identical to the others. For example, the first row contains three "A" patterns, and the second row contains three "B" patterns. A plurality of first arrangements are printed on the web, and the web is severed along a boundary between each arrangement to form a plurality of sheets. The sheets are stacked, forming a first stack. In the above example, each sheet bears 18 images.

A second arrangement is selected to cause the patterns to rotate in a selected sequence when collated, such that the pattern appearing in each printing position in the arrangement is different than the same printing position on adjacent sheets. For example, the second arrangement includes a sequence of B, C, A, B, C, A printed patterns along a length (column), and identical patterns printed across a width (row). A plurality of second arrangements are printed on the web, and the web is severed along a boundary between each second arrangement, forming a plurality of sheets. Each sheet is stacked, forming a second stack. In the example, each sheet in the second stack bears 18 patterns.

A third arrangement is selected in which each printing position differs from the corresponding printing position of the first and second arrangements. For example, a sequence of C, A, B, C, A, B appears along the length of the web, and three patterns are printed across each row, each pattern in a row being again identical to the other patterns in the row. The web is printed, and severed along the boundary between each third arrangement. A plurality of sheets are collected and stacked, forming a third stack.

The three stacks are collated, cut into smaller stacks, and are bound to form a plurality of checkbooks, each book having one printed pattern per page, and each book having a plurality of different background patterns, each appearing in a selected sequence on consecutive pages in the book.

A third known method of forming bound books with multiple background patterns requires additional cutting as well as collating. An arrangement of background patterns is printed onto the web. The web is severed along the outer boundaries of the arrangement. For example, three wildlife illustrations A, B and C, appear along the length of the sheet in the following order: A, B, C, A, B, C. Three background patterns are printed across the width of the web. For example, the first row of the arrangement contains three A patterns, the second row contains three B patterns, etc. The printed web is cut along the boundary of the arrangement—across the width of the web. Each sheet contains eighteen background patterns and is individually cut along a width, forming six strips of three images. The six strips are stacked in order and are then cut into three smaller stacks. The smaller stacks are then bound to form checkbooks.

Each of the above-mentioned methods requires collating, cutting and stacking steps which are time consuming and add extra expense to the cost of manufacturing checkbooks having multiple background patterns.

DETAILED DESCRIPTION OF THE PREFERRED EMBODIMENTS

Figure 1:
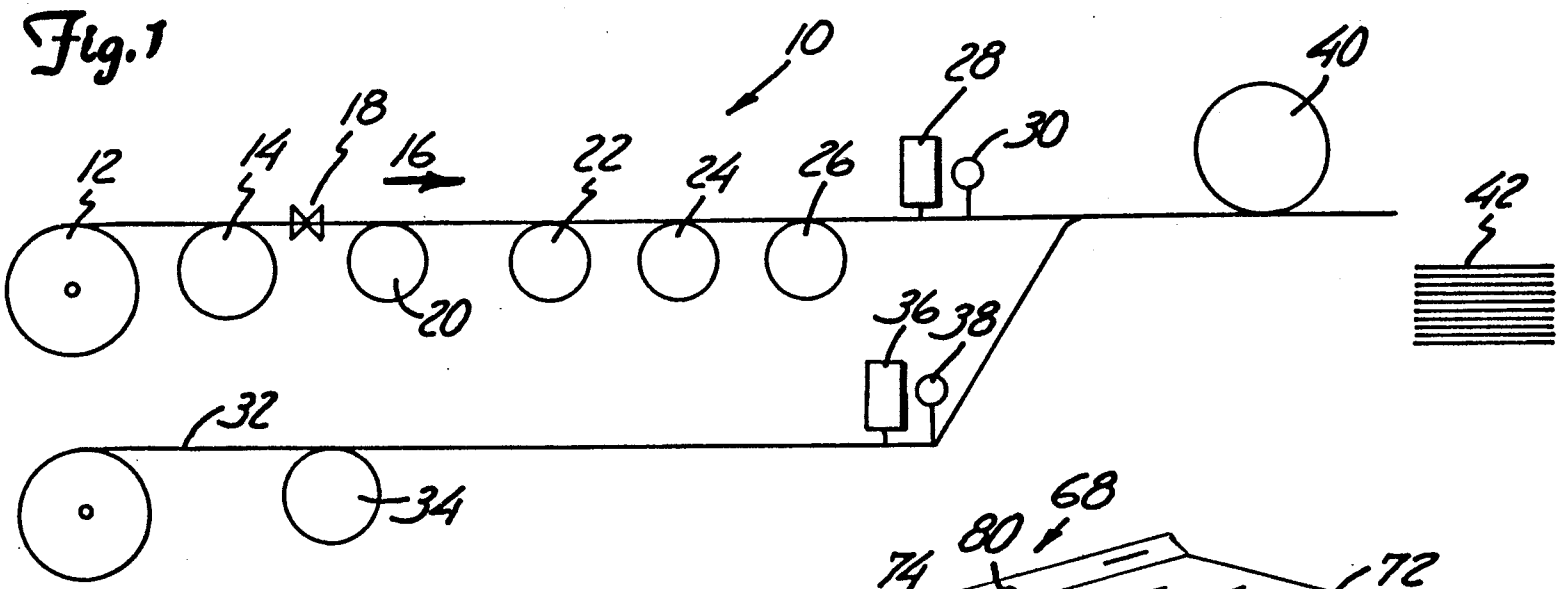
FIG. 1 is a schematic diagram of a printing press suitable for performing the method of the present invention.

The present invention is a method of forming a stack of printed sheets, each sheet having an arrangement of at least two different background patterns, and each sheet in the stack having an arrangement that differs from the arrangement on the adjacent sheets. After a plurality of sheets are printed and stacked, the stacks are severed along the boundaries between each background pattern to form a plurality of smaller stacks. Each smaller stack is bound, forming a plurality of bound books.

A checkbook formed in accordance with the present method contains a plurality of pages with one printed pattern on each page and appearing in a selected repeating sequence on consecutive pages. The present method eliminates the sorting, cutting and collating steps of the prior art methods of forming checkbooks having multiple background images.

The present invention includes the step of printing an arrangement of background patterns onto a web of flexible material such as paper, for example. A "web" for purposes of this disclosure is an elongated, flexible sheet of material, capable of accepting printed patterns. The preferred web is a roll of paper, having a fifteen inch width and a length of several thousand feet. The dimensions of the web are not critical to the invention.

The arrangement includes a row of X printed patterns positioned across the width, and a column of Y printed patterns or a multiple of Y patterns printed along the length. Although the selected value of Y is not critical to the present invention, Y must be an integer greater than one. In the most preferred embodiment, Y is equal to three, and each column contains 2Y patterns. X is any integral and clearly must be at least equal to 1 to carry out the present method. The most preferred value of X is 3.

A plurality of arrangements of X times 2Y printed patterns are printed onto the web. The web is next cut to produce a plurality of sheets which include X images along the width, and Z images along a length.

A critical aspect of the present invention is in the selection of the value Z. Z must be an integer that is greater than one, and is a number other than a prime number of Y or a multiple of a prime number of Y. For purposes of this disclosure, "a prime number of Y" is a number which Y can be divided by to arrive at an integer, and which is only divisible by itself and one. For example, if Y is equal to 15, an appropriate Z value would be a number which is not 3 or 5 because 3 and 5 are both prime numbers of 15. Z also cannot be a multiple of 3 or 5, and must be at least equal to 2. In this example (Y=15), appropriate Z values are 2, 4, 7, 8, 11, 13, 14, etc.

By selecting a certain Z value, printed patterns in a selected printing position on each printed and cut sheet rotate in a selected sequence. A "printing position" for purposes of this specification is an area on the web which is to be printed with a single printed background pattern. By selecting a Z value which is equal to Y+1, the set of Y images (for example, A, B and C) rotates in an order opposite the selected sequence of Y (i.e., C, B, then A). By selecting a Z value equal to Y - 1, a sequence of Y printed patterns rotates in the forward direction (i.e., A, B, then C). The same result applies if Z is equal to a multiple of Y+1, or a multiple of Y minus 1, respectively. For example, a Z value equal to 2Y+1 would also cause the sequence to rotate in the backward direction in the stack.

Many other Z values which are not multiples of +1 or −1 may be used to form a stack of printed sheets if the precise sequence of different printed patterns is not critical. For example, if all that is required of a printed product is that 10 different patterns appear in any given order and that the sequence of ten patterns repeats on consecutive pages, other Z values not equal to Y+1, Y−1, a multiple of Y plus or minus 1 (e.g., 3Y+1 or 5Y−1) also cause the images to rotate.

To avoid repetition of a pattern or consecutive pages of the final bond product (book), each printed pattern in the set of Y patterns is different from the other printed patterns in the set. A desirable feature in checkbooks having more than one background pattern is for one pattern to appear on each page, and for a set of Y patterns to appear in a repeating sequence on consecutive pages. In a preferred checkbook formed by the present method, no two adjacent pages bear an identical background pattern, and no single pattern appears more frequently than the others. Each book bears about the same quantity of each different background pattern in the set. However, if the total number of background images per book is not divisible by Y, then there will be slightly more of some patterns than others in a particular book.

The present method includes selecting an arrangement of background patterns, the arrangement having X patterns across the width, and Y or a multiple of Y printed patterns along the length. A plurality of arrangements are printed onto a continuous web. The web is next cut in a direction transversing the web, forming a plurality of sheets of base stock having X patterns printed across the width, and Z patterns printed along the length (in the direction of travel of the web). The sheets are stacked in the order cut. The sheets are positioned in the stack such that the leading edges of each sheet leaving the printer form one edge of the stack of printed sheets. The printed patterns on each sheet must also face the same direction as the other sheets in the stack. For example, the printed patterns on each sheet in the preferred embodiment all face upwardly.

The most important aspect of the present invention is in the selection of the value Z. As mentioned above, Z must be an integer, which is greater than one, and must be equal to a number which is not a prime number of Y, and is not a multiple of a prime number of Y. By selecting an appropriate Z value based on the selected Y value, it is possible to cause a desired sequence of each pattern in the set Y patterns to appear on consecutively stacked pages at a selected printing position.

FIG. 1 is a schematic diagram of a printing press used to practice the method of the present invention. The printing press 10 in the preferred embodiment is used to print base stock for forming checkbooks having sets of background patterns consisting of multi-colored illustrations. A "background pattern" for purposes of this specification is an artistic illustration such as a landscape, wildlife illustration, or a geometric design, for example. "Base stock" for purposes of this specification is a printed sheet bearing a plurality of background patterns. Individualized information may later be printed onto the base stock in a known manner to form a wide variety of printed materials such as personalized checks, and tickets having consecutive numbering.

The printing press 10 receives a first continuous web 12, the web 12 in the preferred embodiment is printing grade paper having about a 15 inch width. The first continuous web 12 has an arrangement of patterns printed onto a first surface such as lines for endorsing a check, for example. The first surface according to the preferred method later becomes the lower surface (or back) of the check.

A first printing drum 14 has an 15 inch printing width, measured along the central cylinder axis, and has an outer circumference of about 18 inches. One revolution of the first printing drum 14 prints the back of 18 checks.

The checks printed according to the preferred method are positioned such that the long end of each check is perpendicular to the direction of the flow of the web 12 as shown by arrow 16. Each revolution of the drum 14 prints the back of three checks across the width of the drum, and six checks in the direction of travel 16 of the web. Each check measures about 5 inches by about 3 inches. The outer boundary of the group of eighteen checks defines an arrangement of printed patterns or check backs. After a plurality of arrangements of check backs are printed onto a first surface of the web 12, the web is inverted by crossbars 18.

The web 12 next passes through a second printing drum 20 which transfers black images onto the second surface of the web. The second surface in this example later becomes the upper, or front, surface of the check. Examples of black images are horizontal lines for the payor's signature, blocks for inserting the amount of the check, words such as "date" and "notes", and border designs. The second printing drum 20 also has an 18 inch outer circumference and a 15 inch printing width. The second drum 20 prints an arrangement identical in size to the arrangement printed by the first drum 14. The printing press registers the images on the first and second printing drums 12 and 14 such that the second drum 14 prints onto the same area of the web, only on the opposite surface. The images printed to this point may be printed in any known manner.

A "composite pattern" for purposes of this specification is a printed pattern formed by sequentially applying at least two inks to form a multicolored image.

Assuming a three color printing process (four color if the printing drum 20 is taken into account), the web 12 next travels through a third printing drum 22 which deposits an arrangement of the cyan portions of a composite, multicolored background pattern onto the web. The printing press 10 registers the third drum 22 with the second drum 14 such that the cyan colors are deposited within the same boundaries of the composite pattern. The preferred method includes using a third printing drum 22 having an 18 inch outer circumference. The web 12 then moves to the fourth printing drum 24 which deposits the magenta portion of the pattern. The fourth printing drum 24 is registered with the third 22 such that the magenta pattern is deposited directly onto the composite black and cyan pattern. The web 12 then travels to the fifth printing drum 26 where the yellow portions of the arrangement are deposited onto the black, cyan and magenta composite pattern. The preferred method includes the use of a fourth printing drum 24 and a fifth printing drum 26, each having an outer circumference of 18 inches.

The web 12 is next perforated in a direction perpendicular to the direction of travel 16 of the web. Checkbooks and share draft books are typically bound along on edge of the book. Check base stock formed by the preferred method can eventually be bound along a top edge of the checkbook, for example. In order to remove each check from the binding, it is desirable to perforate the sheets at a point slightly below the binding. The perforation device 28 in the preferred embodiment applies about eight equally spaced 1/16 inch long perforations per inch spaced closely to the top edge of each background pattern. The perforation lines are ironed in a creasing device 30 after perforation.

The method of the present invention may include an additional step of printing a second web 32 simultaneously with the first web 12. The second web 32 is printed on one surface only by a sixth printing drum 34 which applies lines and characters, forming an arrangement of check duplicates. The sixth printing drum 34 in the second preferred method has an outer circumference of 18 inches and a width along the main cylinder axis of 15 inches and prints a total of 18 checks per revolution (three checks across, and six checks along the length).

A second perforation device 36 is provided for forming a perforation line across the top of each check duplicate. Because the second web 32 is typically formed of paper which is more light in weight and is weaker than the first web 12, fewer perforations are required. Typically, four equally spaced 1/16 inch long perforations per inch are sufficient to provide a weakened tear line. A creasing device 38 may optionally be provided to further weaken the perforation lines of the check duplicates.

After perforation, the webs 12 and 32 are brought together and pass through a cutting drum 40. Because the presence or absence of the second web 32 is not critical to the present method, the remaining discussion is only concerned with the base stock formed from the first web 12.

The web 12 is next severed transversely along a cutting line defined by the trailing edge of an arrangement of X patterns wide, by Z patterns long. In the preferred embodiment, the outer circumference of the cutting drum 40 measures about 15 inches. Because the outer circumference of the printing drums 14, 20, 22, 24, 26 and 34 are each 18 inches, the cutting drum 40 severs the web 12 in a place other than the trailing end of the composite printed pattern arrangement formed from one complete revolution each of printing drums 14, 20, 22, 24, 26 and 34.

As each sheet exits the cutting drum 40, the sheets are stacked. Each sheet of base stock retains the same orientation relative to the other sheets. The most preferred method includes allowing each sheet of base stock to fall downward as the sheet exits the printing press. The leading edge of the sheets collectively form an edge of the stack 42. In another embodiment, each sheet is inverted, such that each sheet is stacked with the composite patterns facing downwardly, and the leading edge of each sheet being proximate the cutting roll. Although the present invention is illustrated by a four color printing method, the present invention is not limited to multicolor printing. For example, base stock having single color background patterns can be manufactured according to the present method. An example of such a pattern is a black and white image.

The present invention may be more clearly understood by reference to the following examples.

Example I

The previous discussion explains generally how to prepare a stack of base stock, each page containing an arrangement of a number of background patterns, the arrangement including a number of different background patterns. In this example, an arrangement of 3 different printed images is selected for forming a checkbook. The printing press cylinders 14, 20, 22, 24, and 26 are each set up to produce an arrangement of six background patterns positioned along the length of the web, in the direction of travel of the web, and three background patterns positioned across the width of the web.

Figure 2:
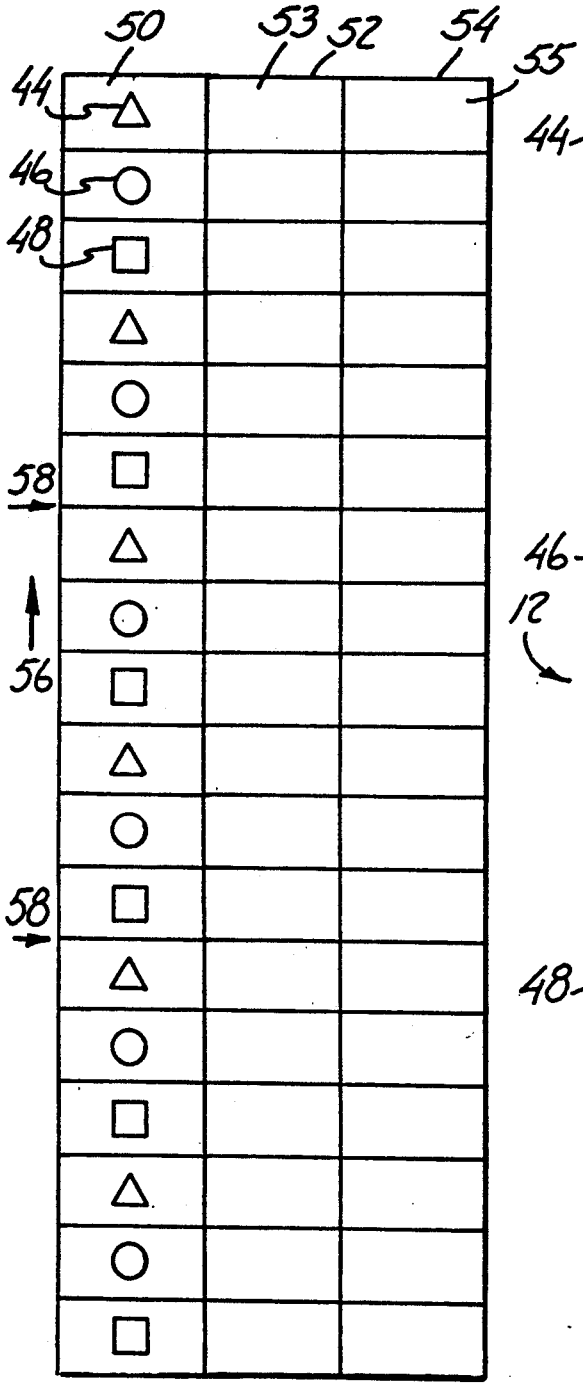
FIG. 2 shows a web after printing in accordance with the present invention and prior to cutting.

FIG. 2 is a diagram of the web after printing. The web in this example includes three columns, numbered 50, 52 and 54. Each rectangular shaped area on the web represents a printing position. The printing positions contained in columns 52 and 54 in the illustration at FIG. 2 do not show printed patterns for the sake of simplicity and clarity. However, it is intended that each printing position contain a printed pattern in each printing position. The patterns are not shown because the printed patterns in each row are identical to the adjacent printed patterns in that row. For example, printing areas 53 and 55 each contain a triangle identical to the triangle 44.

By cutting the web at a boundary between printing positions other than the boundaries of the printed arrangement formed by the registered imprints of printing drums 14, 20, 22, 24, and 26 (indicated by the arrows 58 in FIG. 2), the printed patterns appearing on a selected printing position in sequentially severed sheets are indexed. "Indexing" for purposes of this disclosure is causing a number of different background patterns to appear in a selected order at a selected printing position on consecutive pages in the stack. Indexing the background patterns provides the advantage of eliminating cutting and collating steps when forming bound checkbooks.

A set of background patterns are first selected and arranged in a preselected sequence. For example, in FIG. 2 a set of three background patterns represented by a triangle 44, a circle 46 and a square 48 are selected. The illustrated selected sequence of background patterns is: triangle, circle, square, triangle, circle, then square. In this example, Y, or the number of different patterns, is equal to 3. A quantity of 2Y patterns appears along the length of the arrangement of printed patterns. Three printed patterns appear across the width of the arrangement. A total of eighteen patterns consisting of three different patterns form the arrangement with the boundary between arrangements being indicated by the arrows 58.

A plurality of the above arrangements are printed onto a continuous web of paper. As shown, the trailing end of an arrangement of printed patterns abuts the leading edge of the second printed arrangement at 58. The arrangement is printed a number of times until a continuous sheet 12 of printed arrangements is formed.

Figure 3:
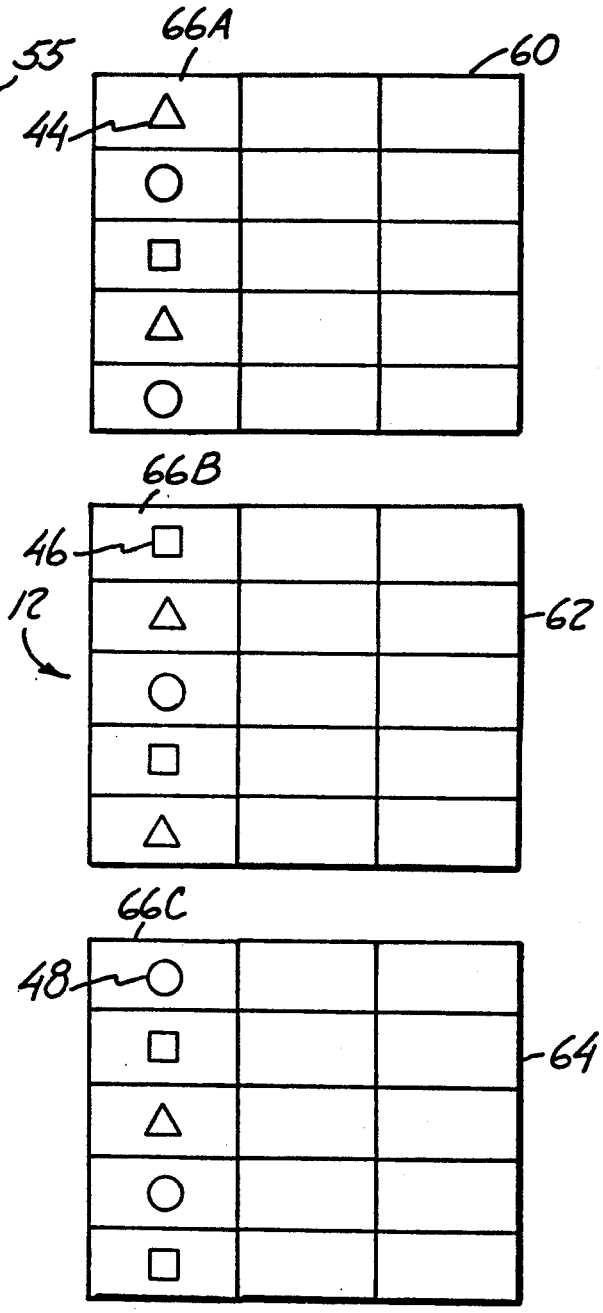
FIG. 3 shows a plurality of consecutively printed sheets, printed according to the method of the present invention.

A Z value is next selected to cause the images to become indexed according to a preselected order. A Z value of 5 (Z equal to $2Y-1$) allows the patterns to rotate in a forward direction (e.g., triangle, circle, then square). FIG. 3 illustrates the printed sheets after passing through a cutting drum 40 (shown in FIG. 1) with a Z value of 5. The web 12 is severed into a plurality of sheets 60, 62 and 64, each sheet 60, 62, 64 containing 15 background patterns. The first printing position 66A on sheet 60 is located in the top left hand corner of the sheet 60. The first position 66B on sheet 62 is located in the top left hand corner of sheet 62. The first position 66C on sheet 64 is located in the top left hand corner of sheet 64. A different background image is present in the first position of each adjacent sheet with the patterns appearing in the selected forward sequence.

By consecutively stacking each sheet 60, 62 and 64 into a stack having the leading sheet 60 positioned on the bottom and the trailing sheet 64 positioned along the top, each background image contained on a selected printing position is different from the background image on the adjacent sheet. The set of Y patterns appear on a selected printing position on consecutive pages in a selected order.

By selecting a printing drum having an 18 inch outer circumference and by selecting a cutting drum having a 15 inch circumference, each sheet severed from the web contains an arrangement of printed patterns which differs from the sheets which were cut from adjacent positions on the web. The images 44, 46 and 48 appear in a repeating selected order of 48, 46, then 44 on consecutive pages on the first position 66A, 66B and 66C. Although this example employs the use of a cutting drum which has a smaller diameter than the printing drums, the present invention also contemplates the use of a printing drum having a diameter which is larger than the diameter of the printing drums.

Example II

In order to form a bound checkbook having five different images (Y is equal to 5), a printing drum which prints 2Y background patterns per revolution along the length of the drum may be employed. A Z value is selected which is greater than 1, and a number other than 5 or a multiple of 5. In this example, X is equal to 3, Y is equal to 5 and a Z value of 6 is selected. The five background patterns A, B, C, D, and E appear on each consecutive sheet in that order on each printing position in the stack. The set of Y patterns becomes indexed on each printing position in the stack. Although the printed patterns rotate in the selected sequence E, D, C, B, then A, some of the printing positions begin with a pattern other than "A." For example, the top left printing position on the first sheet contains the pattern "A," while the second printing position in the left column contains the pattern "B."

Example III

Another example of the present invention includes forming a stack of base stock having 40 different printed patterns, one on each page. The patterns in this example are represented by the letters A - Z, and AA - NN. In this example, Y =40. Prime numbers of 40 include 5 and 2 ($5\times2\times2\times2=40$). Therefore, any number other than 1, 2 or 5 as well as any multiple of 2 or 5 are appropriate values to select as Z. Z may be selected from the group consisting of the set: 3, 7, 9, 11, 13, 17, 19, 21, 23, 27, 29, 31, 33, 37, 39, 41, 43, . . . etc.

In this example, a value of 11 is selected for Z. The cutting drum is selected to cut an arrangement of printed patterns having a width of three patterns, and a length of 11 patterns. Each of the 33 printing positions in the stack contain one of the 40 original patterns, and a sequence of 40 patterns appears from page to page at each printing position. The following sequence of patterns appears on each printing position: A, L, W, HH, E . . . etc.

Although the presently most preferred method (as described in Example I) of printing background patterns onto base stock employs the use of a 15 inch wide by an 18 inch circumference rotating printing drum, the method of the present invention is not limited by the structure of the printing apparatus. The method of the present invention may be practiced with any printing technique that provides at least two different background images printed in the direction of travel of the web.

The present invention is also not limited to three or four color processing methods. For example, a single printing drum could be used to print an arrangement of different patterns of a single color onto the web. FIGS. 2 and 3 illustrate a web 12 printed with single color images. The present invention is also not limited to using a printing press having printing drums. For example, a plate-type press may be used to print the arrangement of printed patterns.

An important aspect of the present invention is to print Y images along a length and to cut the printed web in a direction transversing the direction of travel of the web to form a plurality of sheets having Z images along the length of each sheet. Z is selected to be a number greater than 1, and not equal to a prime number or a multiple of a prime number of Y.

The present invention is also not limited to printing presses having attached cutting devices, or rotating cutting drums. For example, a printing press may press print the background images onto the continuous web, and then roll the web back up into a roll for later cutting on a separate cutting device.

In order to use the stacks of printed sheets of the present invention to form checkbooks or share drafts, a stack of sheets 42 as shown in FIG. 1 is removed from the printing press 10 and is processed in a second press (not shown) which applies customized information such as the name and address of the customer, the bank account numbers, and the name of the bank or the credit union which created the account. After this printing step, the sheets are restacked in the same order in which the sheets left the first printing press 10. Alternatively, the sheets may be stacked in an order opposite the stacking order from the first printing press 10.

Figure 4:
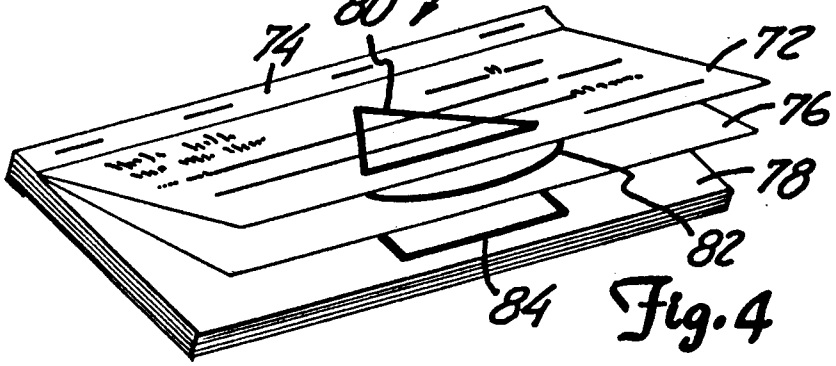
FIG. 4 illustrates a book of checks, formed from a stack of printed material in accordance with the method of the present invention.

FIG. 4 shows a checkbook formed from a stack of printed sheets formed according to the method of the present invention. To form the checkbook 68, a stack of 40 processed printed sheets are cut along the boundaries 70 between printed patterns (as shown in FIG. 3), which define the outer edges of each check 72. By cutting along the boundaries 70, a plurality of smaller stacks of printed sheets are formed. Each smaller stack is bound along an edge 74, forming a plurality of checkbooks. Each checkbook has 40 pages 72, 76, 78, etc., each bearing an image 80, 82, 84 which is different from the adjacent sheets. From the first page to the last page in each checkbook 68, the printed images 80, 82 and 84 are indexed, and repeat in the selected order 80, 82 and 84 in the book.

The present method provides an efficient method of forming printed stacks of sheets bearing multiple images which can be conveniently cut and bound and formed into checkbooks without requiring any sorting or collating steps. Although the present invention has been described with reference to preferred embodiments, workers skilled in the art will recognize that changes may be made in form and detail without departing from the spirit and scope of the invention.

What is claimed is:

1. A method of forming a stack of printed sheets, each sheet having an arrangement of printed patterns with each printed pattern being printed at a designated printing area and each sheet in the stack bearing a different arrangement of printed patterns than adjacent sheets, wherein a selected sequence of printed patterns, including at least two different patterns appears along a length of each sheet and on consecutively positioned sheets in the stack, the method comprising:

printing a plurality of printed pattern arrangements onto a web of paper, each arrangement bearing at least one printed pattern along a width, and at least Y printed patterns or a multiple of Y printed patterns along a length in a selected sequence;

cutting the web across the width along a boundary between adjacent patterns to form a plurality of sheets, each sheet comprising Z printed patterns along a length wherein Z is an integer which is greater than one and which differs from a prime number of Y, or a multiple of a prime number of Y; and stacking each sheet in the order in which the sheets are cut, forming a stack, wherein the selected sequence of printed patterns or its reverse, appears on a selected printing area of consecutively stacked sheets.

2. The method of claim 1 wherein the set of Y printed patterns consists of three patterns, designated A, B, and C, wherein Z is equal to five, and the selected sequence of patterns printed on a selected printing area of consecutive printed sheets is A, B, then C.

3. The method of claim 2 wherein the length of the arrangement consists of a set of 2Y printed patterns, wherein Z is equal to 5, and the selected sequence of patterns printed on a selected printing area of consecutively cut sheets is A, B, C, A, B, then C.

4. The method of claim 1 wherein the arrangement comprises three printed patterns along a width of the web.

5. The method of claim 1 wherein the arrangement comprises a set of six printed patterns along the length, and three printed patterns along the width, the arrangement being printed by one revolution of a printing drum.

6. The method of claim 5 wherein the printing drum has about an 18 inch outer circumference and has about a 15 inch width along a central axis of rotation.

7. The method of claim 5 wherein the set is comprised of three different patterns 8. The method of claim 6, wherein Z is equal to five, and the cutting step is completed by using a cutting roller having an outer circumference of about fifteen inches.

9. The method of claim wherein the step of printing comprises the step of printing using a three color process printing method.

10. The method of claim 1 wherein the step of printing comprises the step of printing using a four color process printing method.

11. The method of claim 1 and further comprising the step of printing on second side of the web.

12. The product of the process of claim 1.

13. The product of claim 12, wherein the printed patterns are background designs for checks, and the printed sheets are base stock for forming personalized checks.

14. The product of claim 12, wherein the printed patterns are background designs for share drafts, and the printed sheets are base stock for forming personalized share drafts.

15. The method of claim 1 wherein each sheet in the stack has a positional orientation identical to the orientation of each other sheet in the stack.

16. A method of claim 15 wherein each sheet is positioned such that the printed patterns appear on an upper surface of each sheet in the stack.

17. A method of forming a stack of sheets of base stock, each sheet bearing a plurality of designated printing areas and a printed pattern on each printing area with at least one printed pattern along a width and a selected sequence of printed patterns, including patterns which differ from the others, along a length of each sheet, the sequence of patterns appearing on consecutively printed sheets at a selected printing area, the method comprising:

providing a web having an arrangement of printed patterns, the arrangement comprising at least one printed pattern along a width, and Y or a multiple of Y printed patterns along a length;

cutting the web across the width between adjacent printed patterns into a plurality of sheets, each sheet having Z patterns printed along a length with Z being greater than one and equal to a number other than a prime number or a multiple of a prime number of Y; and stacking a plurality of sheets of base stock in the order cut to form a stack, a selected printing area of consecutive sheets in the stack bearing printed patterns in the selected sequence or the reverse thereof.

18. The method of claim 15 and further comprising the steps of:

cutting the stack along a boundary between adjacent printed patterns to form smaller stacks; and binding each smaller stack along an edge to form a plurality of books, each book having a plurality of pages with each page containing a printed pattern in a repeating selected sequence on consecutively positioned pages in the book.

19. A method of forming a stack of base stock from a plurality of printed sheets, each sheet having a plurality of printing areas, wherein a plurality of arrangements of printed patterns are printed onto a web, each arrangement comprising a plurality of different patterns with one pattern being printed at each printing area and each arrangement comprising a selected sequence containing Y or a multiple of Y printed patterns arranged along the length of the web, Y being greater than one, and at least one pattern printed along a width, wherein each pattern in the sequence appears on a selected printed position on consecutively stacked sheets cut from the web, in the selected sequence, the method comprising:

printing a plurality of arrangements of printed patterns onto the web, each outer boundary of an arrangement being defined by a single imprint of a printing drum;

cutting the web across a width along a boundary between printed patterns, to form a plurality of sheets, each sheet bearing Z printed images along a length with Z being an integer greater than one and a number other than a prime number of Y or a multiple of a prime number of Y; and stacking each sheet in the order cut to form a stack of base stock, at least one printing position of each sheet bearing a printed pattern from the group of Y printed patterns, and each printed pattern from the group of Y patterns appearing in the selected sequence on consecutively stacked pages at a printing position.

20. The method of claim 19 wherein the step of cutting comprises the step of cutting with a cutting

21. The method of claim 20 wherein the printing drum has an 18 inch circumference, and the cutting drum has a 15 inch outer circumference.

* * * * *

UNITED STATES PATENT AND TRADEMARK OFFICE

CERTIFICATE OF CORRECTION

PATENT NO. : 5,020,434

DATED : June 4, 1991

INVENTOR(S) : David L. Copham

It is certified that error appears in the above-identified patent and that said Letters Patent is hereby corrected as shown below:

Title page:

In the References Cited Section, under U.S. PATENT DOCUMENTS, insert:

| | | | |
|---|---|---|---|
| Re. 27,298 | 2/1972 | Folino | 270/1 |
| 2,427,611 | 9/1947 | Lane | 242/56 |
| 2,469,526 | 5/1949 | Sloat | 101/226 |
| 3,692,298 | 9/1972 | Peacock | 270/12 |
| 4,287,824 | 9/1981 | Boyle | 101/45 |
| 4,368,665 | 1/1983 | Boyle | 101/93.01 |
| 4,593,893 | 6/1986 | Suter | 270/52.5 |

Col. 10, line 42, delete "claim", insert --claim 1--

Col. 11, line 21, delete "claim 15", insert --claim 17--

Col. 12, line 21, delete "of", insert --on--

Col. 12, line 28, after "cutting", insert --drum.--

UNITED STATES PATENT AND TRADEMARK OFFICE

CERTIFICATE OF CORRECTION

PATENT NO. : 5,020,434

DATED : June 4, 1991

INVENTOR(S) : David L. Copham

It is certified that error appears in the above-identified patent and that said Letters Patent is hereby corrected as shown below:

Column 12, line 28, after "cutting," insert --drum--.

Signed and Sealed this

Twenty-ninth Day of September, 1992

*Attest:*

DOUGLAS B. COMER

*Attesting Officer*

*Acting Commissioner of Patents and Trademarks*